US005169715A

United States Patent [19]

Maubert et al.

[11] Patent Number: 5,169,715

[45] Date of Patent: Dec. 8, 1992

[54] HIGH GLOSS BASE PAPER

[75] Inventors: Claude Maubert, Annecy; Henri Vallet, Aix les Bains, both of France

[73] Assignee: Societe Anonyme: Aussedat-Rey, Velizy Villacoublay, France

[21] Appl. No.: 505,024

[22] Filed: Apr. 5, 1990

[30] Foreign Application Priority Data

Apr. 10, 1989 [FR] France ..... 89 04939

[51] Int. Cl.[5] ..... B32B 5/16; B05D 1/36

[52] U.S. Cl. ..... 428/331; 428/537.7; 428/514; 428/448; 427/411

[58] Field of Search ..... 428/537.7, 331, 514, 428/448

[56] References Cited

U.S. PATENT DOCUMENTS 3,873,643 3/1975 Wu et al. ..... 260/878 R 4,248,939 2/1981 Parsons .

OTHER PUBLICATIONS

Abstract Bulletin, vol. 57, No. 5, Nov. 1986, p. 748, No. 6686, Appleton, Wis.; JP-A-84 115 582.

*Primary Examiner*—P. C. Sluby

*Attorney, Agent, or Firm*—Ostrager & Chong

[57] ABSTRACT

The base paper, according to the invention, comprises at least on one face:

a first coat or base coat of a conventional coating slip applied at the rate of 3 to 25 g/m2, at least one superposed coat, applied at the rate of 1 to 10 g/m2, and containing conventional pigments, at least one conventional binder and gloss pigments in the proportion of at least 20% by weight on dry matter with respect to the whole fill of pigments of said superposed coat, and having a granulometry comprised between 0.05 and 1 μm, and being preferably around 0.5 μm.

The invention finds an application in the production of a high gloss paper.

16 Claims, No Drawings

HIGH GLOSS BASE PAPER

FIELD OF THE INVENTION

The present invention relates to the papermaking technique and more particularly to the production of special papers comprising on at least one face, a coating which is designed to give them special properties.

The invention is more particularly concerned with what is known as special papers, with the characteristic of having a high degree of gloss, and used in printing, notably in advertising.

The current tendency is to use so-called high gloss papers, namely papers which have on one face a degree of gloss at least equal to, and preferably even higher than 85%.

BACKGROUND OF THE INVENTION

Two techniques are currently known to be used for preparing such papers.

The first technique which is known as chromium cylinder coating or "cast coating", consists in feeding the paper web to be treated over a perfectly polished and heated chromium-plated cylinder which said web partly encircles, after the web has been picked up by two reversing rollers.

Just before wrapping around the heated chromium-plated cylinder, the paper web is coated, on its internal face, for example by injection, with a coating slip containing, besides the conventional pigments, special binders and additives which will enable the coating to retain a certain malleability while said coating is in contact with the chromium-plated cylinder and which will make it then easier to detach from the cylinder.

The coating slip is spread out, compressed and heated between the paper and the chromium-plated cylinder, in order to go through, simultaneously to being spread, a sort of simultaneous calendering and drying.

Adequate results may be obtained with feeding speeds ranging between 0 and 50 or 100 m/min. This limited feeding speed requirement corresponds to the necessity to have, on the other side of the cylinder, a paper which is dry enough to be detachable from the chromium-plated cylinder.

The disadvantage of this type of technique is, therefore, a low speed of production which, besides, demands a specific installation to ensure the winding of the paper web, the permanent heating of the chromium-plated cylinder expensive to produce, and the injecting of the coating slip.

A further disadvantage of such a technique is the difficulty in producing a paper exhibiting a high degree of gloss on both faces. Indeed, when the second face is coated, the discharged steam has to go through the paper and the coating of the first coated face. When this steam is discharged, it damages the coating of the first face and makes it impossible to obtain a suitable second face because of a slowing down in the discharge of the steam imposed by the necessity for it to go through the paper and the first applied coating.

Moreover, this technique is also known to be unsuitable for adequately coating a base other than paper, and in particular a plastic material base, due to the non-permeability of such a material.

A second technique consists in applying a coating slip, by the conventional methods, such as with a trailing blade coater, on one face of a base paper, the coating slip being composed so as to contain an adequate quantity of plastic pigments, hereinafter designated also as gloss pigments, and constituted of spherical particles of mean diameter ranging between 0.05 and 1 μm, and being preferably around 0.5 μm.

According to this technique, the coating is applied over a sufficient thickness, generally between 3 and 25 μm, to obtain a coating strong enough to go through a calendering treatment.

After calendering, and as a result of the dispersion of the gloss pigments through the thickness of the coating, an obvious gloss characteristic is noted but this does not reach the target 80%, even with gloss pigment contents reaching up to 30% by weight of pigments conventionally used in the composition of coating slips.

It could be assumed that the way to obtain this characteristic would be in increase in the required proportions, the plastic pigment filler incorporated to the coating slip. Although this step may, in theory, appear obvious, in practice it is not feasible for two reasons.

The first reason is the very high price of the coating slip composition, resulting from the high price of the plastic pigments used therein.

The second reason is that it is found, when taking such a step, that calendering brings about an unexpected side-effect which is harmful. Indeed, as the coating contains a strong proportion of plastic pigments, generally higher than 30% by weight, although it is easily compacted during calendering, it nevertheless suffers a loss of opacity which is harmful in itself, but which is additionally marked by a defective surface commonly known as blackening in the papermaking industry. Such a blackening corresponds to the appearance of a more or less heterogeneous grey color which is the result of a kind of vitrification of the paper. Such a drawback is a serious impediment in the production of high gloss papers of white or pastel color, but even of dark colors.

Therefore, on the whole, the current techniques do not produce a high gloss paper or other base with a degree of gloss at least equal to 80% and in particular, they do not provide a teaching liable to direct the man skilled in the art towards finding a solution to this problem.

SUMMARY OF THE INVENTION

It is precisely the object of the present invention to eliminate this drawback by providing a new process for preparing a high gloss base material, which may be a base paper, but equally also a substrate such as a web or film of plastic material.

The process according to the invention also provides the possibility of, if necessary, treating the two faces of one substrate by using the same operations, performed at intervals, in the case of a treatment process by the continuous feeding method.

These objects and more are obtained according to the invention with a process characterized by the sequence of operations defined in claim 1.

The invention further relates, as a new industrial product, to a high gloss base paper, reaching a degree of gloss at least equal to 80%, having a substrate comprising, on at least one face:

a base coat of a conventional coating slip applied at the rate of 3 to 25 g/m2, at least one superposed coat, called overcoat, of a slip applied at the rate of 1 to 10 g/m2, composed of conventional pigments of which at least 60% have a granulometry smaller than 2 μm, of at least one conventional binder in sufficient quantity and gloss pigments at the rate of at least 20% by weight on dry matter, with respect to the whole fill of pigments of said overcoat, said gloss pigments having a granulometry between 0.05 and 1 μm and being preferably around 0.5 μm.

DETAILED DESCRIPTION OF PREFERRED EMBODIMENTS

The invention will be more readily understood on reading the following description, given by way of example and non-restrictively of special embodiments of the invention.

The process according to the invention for preparing a high gloss base paper consists in using a substrate in sheet, film or board form, of relatively small thickness, generally around 100 μm. Such a substrate is preferably described hereinafter as being a paper produced conventionally, of basis weight for example of 80 g/m2, which may have undergone a size press treatment during its manufacture. The invention is, nevertheless, applicable in exactly the same conditions, to any substrate of different material, and in particular, to a polyester film.

According to a first embodiment, the first operation in the process consists in applying on at least one of the faces of the substrate, a coating slip of composition conventionally used in papermaking, at the rate of 3 to 25 g/m2, more particularly 8 to 15 g/m2, and preferably at a rate of about 10 g/m2. The coated slip is conventional in its composition, its pigments, and the binders and additives conventionally used. One reservation must be made on the word "conventional" because of the necessity to choose, in every case, a composition which must meet certain requirements in order to fulfill the functions for which it was chosen. Such functions include being a bonding medium by constituting a base coat for subsequent coatings, being as white as possible, being of low cost and being able to make good the surface differences normally found on a paper.

For the aforesaid functions to be fulfilled in the best conditions, the coating slip contains the conventional pigments including, preferably, kaolin, pigments which have, for at least 60% of them, a granulometry less than 2 μm. Preferably, the selected pigments have, for at least 90% of them, a granulometry less than 2 μm.

Examples of suitable conventional pigments are calcium carbonates, kaolins, talcs, calcium sulphates, silicoaluminates, satin whites, silicas, aluminas and aluminum hydroxides.

The composition of the coating slip includes, likewise in conventional manner, suitable binders to enable the applied coat to fulfill the aforesaid functions, such as for example synthetic latex, starch, polyvinyl alcohol, and proteins.

In this first example, the coating slip contains no gloss pigments. Said slip is applied so as to form a base coat covering evenly, homogeneously and uniformly, the face of the base paper. Said base coat is applied by any suitable means known in the technique, such as for example with a trailing blade coater.

After applying the base coat, the latter undergoes a natural or induced drying phase, followed optionally by a calendering phase performed by means conventionally used in the papermaking industry, but preferably, at a temperature higher than the ambient temperature in order to obtain an improved gloss. Said temperature may be comprised between the ambient temperature and 150° C., for example between 80° and 100° C. Calendering can be carried out with a pressure ranging between 0 and 300 kg per linear centimeter.

After the application of the base coat, the process according to the invention provides the application of at least one coat called gloss coat, at the rate of 1 to 19 g/m2, and preferably 3 g/m2. The gloss coat is formed with a coating slip containing the conventional pigments, of the type described with reference to the preceding base coat. The slip constituting said gloss coat contains, however, gloss pigments in the proportion of at least 20% by weight on dry matter, with respect to the whole fill of pigments incorporated in said gloss coat. The gloss pigments are selected to have a granulometry comprised between 0.05 and 1 μm and being preferably around 0.5 μm. Examples of particularly suitable products for the target applications are acrylic styrene copolymers such as, in particular, the product sold under the trademark "Ropaque" by the company ROHM & HAAS, or polystyrenes such as the products sold under the trademark LYTRON by the company WILLIAMS.

Particularly remarkable results are obtained by preparing the gloss coating slip with conventional pigments of which at least 60%, and preferably 90%, have a granulometry less than 2 μm. The gloss coating is applied by the conventional coating method, and preferably again the trailing blade method, and is then subjected to a conventional or induced drying followed by a conventional calendering at normal temperature. Said temperature is preferably the highest possible in order to improve the gloss, although it must not exceed 105° C. to prevent the coating from adhering to the rollers of the calender. Calendering will be carried out at conventional pressures, for example ranging between 100 and 300 kg per linear centimeter.

It has been unexpectedly found that when producing an overall coating according to the above-indicated method, namely by applying a base coat followed by at least one gloss coat, it is possible to obtain with a substrate of the abovementioned type, a gloss characteristic close to 85%. This characteristic is obtained without any greying or blackening effect, by using on the whole only a small proportion of plastic gloss pigments which are known to be rather expensive.

Rather unexpected and advantageous results are obtained by applying on the base coat of the above-described type, two superposed so-called gloss coats of similar composition and applied in the same coating conditions. In such a case, it is possible to reduce the proportion of gloss pigments in each coat and still obtain the target result. Adequate results have been obtained with a first superposed coat containing 15% by weight on dry matter of gloss pigments with respect to the whole fill of pigments of said first coat, and with a second gloss coat containing 20% by weight on dry matter of gloss pigments with respect to the whole fill of pigments of said overcoat.

In certain cases, it may be advantageous to compose the gloss coat with 30% by dry weight of gloss pigments, 20% by dry weight of kaolin with respect to the whole fill of pigments of said gloss coat, of which preferably 98% at least have a granulometry of 2 μm, and with conventional pigments and binders in sufficient complementary quantity.

In certain cases in particular, when the base coat contains no kaolin, it is possible to compose the so-called gloss coat with 30% by dry weight of gloss pigments and in addition 70% by dry weight of pure kaolin, such a composition being completed with the ordinary binders and additives in quantity which can vary between 4 and 20% by dry weight for 100 parts by dry weight of the whole of pigments.

By the phrase 'percent dry weight' for the gloss pigments or for the conventional pigments, as considered in the foregoing description, is meant as a reference base, the whole fill of pigments contained in the base coat or in the gloss coat.

By using a conventional coating method, it becomes possible, whenever required, to treat as explained already or in any other way, the two faces of one substrate in totally different and delocalized operations, or else, in successive or simultaneous operations in the case of continuous treatment of a very long paper web.

The high degree of gloss obtained with a small proportion of gloss pigments incorporated in the second gloss coat, permits the production of papers with elaborate characteristics for a particularly advantageous cost price, just by using a conventional process and a material of known implementation.

In a variant, a first coat is applied on the substrate, said coat acting as a base coat as well as a first gloss coat. To this effect, a coat of conventional composition including a proportion less than 15% by dry weight of gloss pigments with respect to the whole fill of pigments of said coat, is applied on the substrate at the rate of 5 to 20 g/m2 and preferably 10 g/m2, according to the conventional methods, followed, after possible drying and calendering, by a second coat containing 20% by dry weight of gloss pigments with respect to the whole fill of pigments of said second coat, applied at the rate of 4 g/m2. The second coat is dried and calendered and the substrate treated in this way has a degree of gloss approaching 87%.

Different examples of embodiment of the process according to the invention are now given by way of illustration.

EXAMPLE 1

A standard base paper, constituted for example of 50% long resinous fibers and 50% short leafy fibers, was used, said base paper being coated with starch in size press during its manufacture, and which showed the following characteristics:

| | |
|---|---|
| G.S.M. | 66.5 gm2 |
| Air porosity-AFNOR Q.03075 | 2.3 |
| Cobb bonding (1 min) (face 1/face 2) AFNOR Q.03014 | 20/18 |
| Bekk glazing (face 1/face 2) AFNOR Q 03012 | 19/21 |
| Hunterlab gloss (face 1/face 2) TAPPI T480 | 5/5 |
| CIE Whiteness (face 1/face 2) GANZ and BRIESSER method | 128/122 |

Step 1

First of all, this base paper was coated on face 1, using a trailing blade coater, with the following coating slip:

60 parts by weight (dry/dry) of ground natural calcium carbonate Hydrocarb 90 produced by the company OMYA, 90% of which had a granulometry smaller than 2 μm, 40 parts by weight (dry/dry) of kaolin HT sold by the company ENGELHARD, 10 parts by weight of synthetic latex DL 670 of the company DOW CHEMICAL FRANCE, with respect to 100 parts by dry weight of calcium carbonate and kaolin, 0.2 parts by weight (dry/dry) of carboxymethylcellulose of average viscosity 7M1 from company HERCULES, with respect to 100 parts by dry weight of calcium carbonate and kaolin, the necessary quantity of water to obtain a preparation having a 65% solids content, the necessary quantity of ammonia to obtain a pH of 9.5.

The coating weight applied on face 1 was 12 g/m2.

Step 2

This paper was coated a second time on face 1, using the trailing blade coater, with a coating slip composed as follows:

30 parts by weight (dry/dry) of synthetic organic pigment Ropaque OP 84 of the company ROHM & HAAS, 70 parts by weight (dry/dry) of fine kaolin Amazon 88, sold by the company EUROCLAY, 98% of which had a granulometry smaller than 2 μm, 16 parts by weight (dry/dry) of synthetic latex Acronal 360 D of the company BASF, with respect to 100 parts by dry weight of Ropaque OP 84 and kaolin, 0.5 part by weight (dry/dry) of carboxymethylcellulose 7M1 of the company HERCULES, with respect to 100 parts by dry weight of Ropaque OP 84 and kaolin, the quantity of water necessary to obtain a preparation having a 51% solids content, the necessary quantity of ammonia to obtain a pH of 9.5.

The coating weight was 4.5 g/m2.

Step 3

This paper was then calendered in the conditions conventionally used to obtain ordinary gloss papers (degree of gloss about 65%).

The resulting paper had the following characteristics:

| | |
|---|---|
| G.S.M. | 83 g/m2 |
| Bekk glazing (face 1) AFNOR Q.03012 | 1350 |
| Hunterlab gloss (face 1) TAPPI T480 | 87.5 |
| CIE Whiteness (face 1) GANZ and BRIESSER method | 96 |
| no blackening. | |

EXAMPLE 2

The paper of Example 2 was produced with the same base and with the same steps 1 and 3 as in Example 1. During Step 2, the following coating was used:

50 parts by weight (dry/dry) of synthetic organic pigment Ropaque OP 84 of the company ROHM & HAAS, 50 parts by weight (dry/dry) of fine kaolin Amazon 88 sold by the company EUROCLAY, 98% of which had a granulometry smaller than 2 μm, 16 parts by weight (dry/dry) of synthetic latex Acronal 360 D of the company BASF, with respect to 100 parts by dry weight of Ropaque OP 84 and kaolin, 0.5 part by weight (dry/dry) of carboxymethylcellulose 7M1 of the company HERCULES, with respect to 100 parts by dry weight of Ropaque OP 84 and kaolin, the quantity of water necessary to obtain a preparation with a 51% solids content, the quantity of ammonia necessary to obtain a pH of 9.5.

The coating weight was 4.5 g/m2.

The paper obtained had the following characteristics:

| | |
|---|---|
| G.S.M. | 83 g/m2 |
| Bekk glazing (face 1) AFNOR Q.03012 | 1370 |
| Hunterlab gloss (face 1) TAPPI T480 | 92 |
| CIE Whiteness (face 1) GANZ and BRIESSER method no blackening. | 97 |

EXAMPLE 3

The paper in Example 3 was produced from the same base material and with the same first step as those of Examples 1 and 2.

Step 2

The paper was coated a second time on the same face 1, using the trailing blade coater, with the following coating composition:

20 parts by weight (dry/dry) of synthetic organic pigment Ropaque OP 84 of the company ROHM & HAAS, 80 parts by weight (dry/dry) of fine kaolin Amazon 88 sold by the company EUROCLAY, 98% of which had a granulometry smaller than 2 μm, 16 parts by weight (dry/dry) of synthetic latex Acronal 360 D of the company BASF, with respect to 100 parts by dry weight of Ropaque OP 84 and kaolin, 0.5 part by weight (dry/dry) of carboxymethylcellulose 7M1 of the company HERCULES, with respect to 100 parts by dry weight of Ropaque OP 84 and kaolin, the quantity of water necessary to obtain a preparation with a 51% solids content, the quantity of ammonia necessary to obtain a pH of 9.5.

The coating weight was 3 g/m2.

Step 3

This paper was coated a third time on the same face and with the same composition as in step 2.

The coating weight was 2.5 g/m2.

Step 4

This consisted in calendering the paper in the same conditions as those of examples 1 and 2.

The paper obtained had the following characteristics:

| | |
|---|---|
| G.S.M. | 84 g/m2 |
| Bekk glazing (face 1) AFNOR Q. 03012 | 1450 |
| Hunterlab gloss (face 1) TAPPI T 480 | 86.5 |
| CIE Whiteness (face 1) GANZ and BRIESSER method | 95 |

EXAMPLE 4

A standard base paper with wood is used which has gone through no coating in size press during its manufacture and characterized by:

| | |
|---|---|
| G.S.M. | 50.5 g/m2 |
| Air porosity AFNOR Q.03075 | 2 |
| Cobb bonding (1 min) (face 1/face 2) AFNOR Q. 03014 | 400/400 |
| Bekk glazing (face 1/face 2) AFNOR Q.03012 | 36/23 |
| Hunterlab gloss (face 1/face 2) TAPPI T480 | 5/4 |

-continued

| | |
|---|---|
| CIE whiteness (face 1/face 2) GANZ and BRIESSER method | 44/46 |

Step 1

First of all, this paper base was coated on face 1, using a gate roll coater, with a coating slip composed as follows:

100 parts by weight (dry/dry) of ground natural calcium carbonate Hydrocarb 90 produced by the company OMYA, 90% of which had a granulometry smaller than 2 μm, 30 parts by weight (dry/dry) of starch baked beforehand in the conventional conditions, with respect to 100 parts by dry weight of calcium carbonate, 0.4 part by weight (dry/dry) of optical white Leucophor CK of the company SANDOZ, with respect to 100 parts by dry weight of calcium carbonate, the quantity of water necessary to obtain a preparation with a 53.5% solids content.

The coated weight was 9 g/m2 on face 1.

Step 2

This paper was given a second coating over the same face 1, with the trailing blade coater, of a coating slip having the following composition:

50 parts by weight (dry/dry) of synthetic organic pigment Ropaque OP 84 sold by the company ROHM & HAAS, 50 parts by weight (dry/dry) of kaolin HT sold by the company ENGELHARD, 16 parts by weight (dry/dry) of synthetic latex Baysthal P 1700 of the company BAYER, with respect to 100 parts by dry weight of Ropaque OP 84 and kaolin, 0.7 part by weight (dry/dry) of carboxymethylcellulose 7 L2C of the company HERCULES, with respect to 100 parts by dry weight of Ropaque OP 84 and kaolin, 0.85 part by weight (dry/dry) of optical white Leucophor CK of the company SANDOZ, with respect to 100 parts by dry weight of Ropaque OP 84 and kaolin, the quantity of water necessary to obtain a preparation with a 51% solids content, the quantity of ammonia necessary to obtain a pH of 9.5.

The coating weight was 4.5 g/m2.

Step 3

The paper was calendered in the same conditions as used in Examples 1, 2 and 3.

The paper obtained had the following characteristics:

| | |
|---|---|
| G.S.M. | 64 g/m2 |
| Bekk glazing (face 1) AFNOR Q.03012 | 1370 |
| Hunterlab gloss (face 1) TAPPI T480 | 81 |
| CIE whiteness (face) GANZ and BRIESSER method no blackening. | 88 |

EXAMPLE 5

The same base paper was used as in Examples 1, 2 and 3.

Step 1

First of all, this base paper was coated on face 1, using a trailing blade coater, with a coating slip composed as follows:

50 parts by weight (dry/dry) of ground natural calcium carbonate Hydrocarb 90 produced by the company OMYA, 90% of which had a granulometry smaller than 2 μm, 40 parts by weight (dry/dry) of kaolin HT sold by the company ENGELHARD, 10 parts by weight (dry/dry) of synthetic organic pigment Ropaque OP 84 of the company ROHM & HAAS, 10 parts by weight of synthetic latex DL 670 of the company DOW CHEMICAL FRANCE, with respect to 100 parts by dry weight of calcium carbonate, kaolin and Ropaque OP 84, 0.3 part by weight (dry/dry) of carboxymethylcellulose 7M1 of average viscosity of the company HERCULES, with respect to 100 parts by dry weight of calcium carbonate, kaolin and Ropaque OP 84, the quantity of water necessary to obtain a preparation with a 65% solids content, the quantity of ammonia necessary to obtain a pH of 9.5.

The coating weight was 12 g/m2 on face 1.

Step 2

This paper was given a second coating on the same face 1 with the trailing blade coater, of a coating slip having the following composition:

20 parts by weight (dry/dry) of synthetic organic pigment Ropaque OP 84 of the company ROHM & HAAS, 80 parts by weight (dry/dry) of fine kaolin Amazon 88 sold by the Company EUROCLAY, 98% of which had a granulometry smaller than 2 μm, 16 parts by weight (dry/dry) of synthetic latex Acronal 360 D of the Company BASF, with respect to 100 parts by dry weight of Ropaque OP 84 and kaolin, 0.5 part by weight (dry/dry) of carboxymethylcellulose 7M1 of the Company HERCULES, with respect to 100 parts by dry weight of Ropaque OP 84 and kaolin, the quantity of water necessary to obtain a preparation having a 51% solids content, the quantity of ammonia necessary to obtain a pH of 9.5.

The coating weight was 4.5 g/m2.

Step 3

This coated paper was then calendered in the conventionally used conditions to obtain ordinary gloss papers (degree of gloss about 65%).

The paper obtained had the following characteristics:

| | |
|---|---|
| G.S.M. | 83 g/m2 |
| Bekk glazing (face 1) AFNOR Q.03012 | 1750 |
| Hunterlab gloss (face 1) TAPPI T480 | 87 |
| CIE whiteness (face 1) GANZ and BRIESSER method | 97 |
| No blackening. | |

The following Table gives the comparative values of printing tests carried out in identical manner on papers according to examples 1 to 5 and on a standard paper of reference.

| PRINTING TESTS | Example No. | | | | | Standard |
|---|---|---|---|---|---|---|
| | 1 | 2 | 3 | 4 | 5 | Paper |
| Offset type ink gloss Lorilleux (*) | 95 | 96 | 95 | 89 | 94 | 82 |
| "Heliotest" printing Number of missing points (**) | 7 | — | 3 | — | 13 | 67 |

(*)The non-standardized offset type ink gloss test consists in printing the paper with an IGT testing press at a speed of 0.2 m/sec. with a pressure of 10 kg/cm2.
(**)The heliotest corresponds to the norm NF Q 61 002.

The invention is not in any way limited to the examples described and illustrated herein and on the contrary various modifications may be brought without departing from its scope.

What is claimed is:

1. A high gloss base material having a degree of gloss equal to at least 80%, comprising a substrate having a first face and a second face, at least said first face being coated first with a base coat comprising a coating slip containing pigment and binder, and later with a first gloss coat superposed over said base coat, said first gloss coat comprising pigments and binder, said pigments in said first gloss coat including mineral pigment having at least 60% by weight of particles with diameter of less than about 2 μm and gloss pigment in an amount of at least 20% by weight on dry matter, with respect to the whole fill of pigments of said first gloss coat, said gloss pigment having particles with diameter between about 0.05 and 1 μm.

2. The high gloss base material of claim 1 wherein said first gloss coat has particles with diameter of about 0.5 μm.

3. The high gloss base material of claim 1 wherein said gloss pigment comprises an organic pigment.

4. The high gloss base material of claim 1 further comprising a second gloss coat disposed between said base coat and said first gloss coat, said second gloss coat comprising pigments and binder, said pigments in said second gloss coat including mineral pigment having at least 60% by weight of particles with diameter of less than about 2 μm and gloss pigment in an amount of at least 15% by weight on dry matter, with respect to the whole fill of pigments of said second gloss coat, said gloss pigment having particles with diameter between about 0.05 and 1 μm.

5. The high gloss base material of claim 1 wherein the whole fill of pigments of said base coat comprises no more than about 15% by weight on dry matter of gloss pigment.

6. The high gloss base material of claim 1 wherein said mineral pigment in said first gloss coat includes kaolin in an amount of at least about 20% by weight on dry matter with respect to the whole fill of pigments of said gloss coat.

7. The high gloss base material of claim 1 wherein the whole fill of pigments of said first gloss coat comprises 30% by weight on dry matter of said gloss pigment and wherein said mineral pigment in said first gloss coat includes kaolin in an amount of about 70% by weight on dry matter with respect to the whole fill of gloss and kaolin pigments of said first gloss coat.

8. The high gloss base material of claim 1 wherein said first gloss coat includes an additive in addition to pigments and binder, and wherein said binder and said additive in said first gloss coat represent an amount of between about 4 and 20% parts on dry matter of said first gloss coat, with respect to 100 parts of the whole conventional and gloss pigments.

9. The high gloss base material of claim 1, further comprising a second gloss coat including binder and pigments, said pigments comprising gloss pigments in an amount of at least 20% by weight on dry matter, with respect to the whole fill of pigments of said second gloss coat.

10. The high gloss base material of claim 1 wherein said substrate is paper.

11. The high gloss base material of claim 1 wherein said substrate is plastic.

12. A high gloss base material having a degree of gloss equal to at least 80%, comprising a substrate having a first face and a second face, at least said first face having a first inferior coat and a second superior coat superposed thereon, wherein said second superior coat comprises pigments including mineral pigment having at least 60% by weight of particles with diameter of less than about 2 μm and gloss pigment in an amount of at least 20% by weight on dry matter, with respect to the whole fill of pigments of said second coat, said gloss pigment having particles with diameter between about 0.05 and 1 μm.

13. The high gloss base material of claim 12 wherein said first inferior coat comprises pigments including gloss pigment in an amount less than 15% by weight on dry matter, with respect to the whole fill of pigments of said first coat, said gloss pigment having particles with diameter between about 0.05 and 1 μm.

14. The high gloss base material of claim 13 wherein said first coat is applied on said first face of said substrate.

15. The high gloss base material of claim 12 wherein said substrate is paper.

16. The high gloss base material of claim 12 wherein said substrate is plastic.

* * * * *